US008333504B2

(12) United States Patent
Hozumi et al.

(10) Patent No.: US 8,333,504 B2
(45) Date of Patent: Dec. 18, 2012

(54) PORTABLE TIMEPIECE

(75) Inventors: Yoshio Hozumi, Chiba (JP); Kazutaka Imai, Chiba (JP)

(73) Assignee: Seiko Instruments Inc. (JP)

( * ) Notice: Subject to any disclaimer, the term of this patent is extended or adjusted under 35 U.S.C. 154(b) by 274 days.

(21) Appl. No.: 12/806,995

(22) Filed: Aug. 25, 2010

(65) Prior Publication Data

US 2011/0051572 A1 Mar. 3, 2011

(30) Foreign Application Priority Data

Aug. 28, 2009 (JP) ..... 2009-198712

(51) Int. Cl.
*G04B 37/00* (2006.01)

(52) U.S. Cl. ..... 368/286; 368/291

(58) Field of Classification Search ..... 368/286–292
See application file for complete search history.

(56) References Cited

U.S. PATENT DOCUMENTS 2,391,803 A * 12/1945 Simon ..... 368/290
3,188,793 A * 6/1965 Morf ..... 368/290
3,525,211 A * 8/1970 Wyssen ..... 368/289
4,783,772 A * 11/1988 Umemoto et al. ..... 368/11
5,257,247 A * 10/1993 Miche et al. ..... 368/290
5,521,890 A * 5/1996 Miche et al. ..... 368/319

OTHER PUBLICATIONS

Patent Abstracts of Japan, publication No. 05-172956, publication date Jul. 13, 1993.

* cited by examiner

*Primary Examiner* — Sean Kayes
(74) *Attorney, Agent, or Firm* — Adams & Wilks

(57) ABSTRACT

A timepiece has a valve that discharges gas from an exterior assembly and includes a casing, a valve member that moves from a closed position to an open position in accordance with an inner pressure of the assembly, an exhaust button movable into the casing, a first spring urging the button and valve member away from each other, and a second spring urging the button toward the exterior of the assembly. When an inner pressure of the assembly is greater than a force of the first spring, the valve member is moved to the open position and a portion of the gas accumulates between the valve member and the button. When the button is moved into the casing, the accumulated gas is discharged to the exterior of the assembly by which the valve member is maintained at the closed position by the spring force of the first spring.

9 Claims, 8 Drawing Sheets

PORTABLE TIMEPIECE

BACKGROUND OF THE INVENTION

1. Field of the Invention

The present invention relates to a portable timepiece in which there is a possibility of the inner pressure of the timepiece exterior assembly being enhanced as in the case of a diver's watch for saturation diving.

1. Background Information

There is known a diver's watch for saturation diving in which, to cope with a case in which the inner pressure of the timepiece exterior case has become higher than the outer pressure thereof, a button of an exhaust valve provided to the case is intentionally depressed, thereby making it possible to forcibly discharge the gas inside the timepiece exterior case to the exterior of the case (See, for example, JP-A-5-172956 Patent Document 1).

The exhaust valve with which this diver's watch is equipped has a stepped hole formed in the case band of the timepiece exterior case, a button, a snap ring, a coil spring, and packing.

The small diameter hole portion of the stepped hole is open to the inner side of the case band, and the large diameter hole portion of the stepped hole is open to the outer side of the case band. The button has an operating portion fit-engaged with the large diameter hole portion, and a shaft portion passed through the small diameter hole portion. The snap ring, which prevents detachment of the button from the stepped hole, is connected to the shaft portion inside the timepiece exterior case. The coil spring is accommodated in the large diameter hole portion while wrapping the shaft portion, and urges the button toward the exterior of the case band. The packing is fixed to the shaft portion. In the normal state in which the button is not pushed in, this packing is in contact with the inner surface of the small diameter portion or of a pipe attached to this hole portion, and exhibits interference; and, in the state in which the button has been pushed in, it is arranged inside the case band and exhibits no interference.

Thus, simultaneously with the pushing-in of the button, the packing is moved so as to be detached from the small diameter portion of the stepped hole into the interior of the timepiece exterior case, and communication is established between the interior and exterior of the case band via the stepped hole. As a result, it is possible to discharge the gas inside the timepiece exterior case to the exterior of the case via the stepped hole.

In a situation in which the button of the exhaust valve is pushed in after saturation diving using the diver's watch of Patent Document 1, there is a possibility of water having been accumulated in the large diameter hole portion of the stepped hole, and, at the same time, the water adhering to the wet hand of the diver may be allowed to enter the large diameter hole portion. Further, in the exhaust valve pushing-in operation under rainy weather, rain water may be allowed to enter the large diameter hole portion. When the exhaust operation is performed in such a situation, there may be a possibility of the water in the large diameter hole portion entering the timepiece exterior case immediately after the completion of exhaust, with the packing exhibiting no interference.

Further, when the button of the exhaust valve is erroneously operated and the exhaust valve is opened, there is a fear of water entering the timepiece exterior case via the stepped hole simultaneously with the completion of exhaust.

As described above, in the prior art technique, there is a fear of water being allowed to enter the interior of the timepiece exterior case from the outside as the degassing operation is performed.

SUMMARY OF THE INVENTION

To solve the above problem, according to the present invention, there is provided a portable timepiece in which a degassing valve having an exhaust button is attached to a timepiece exterior assembly and in which a gas in the timepiece exterior assembly is allowed to escape to the exterior by pushing in the exhaust button, the degassing valve comprising: a valve casing providing communication between the interior and exterior of the timepiece exterior assembly; a valve member accommodated in the valve casing and moved from a closed position to an open position when the inner pressure of the timepiece exterior assembly becomes a predetermined pressure or more; the exhaust button accommodated in the valve casing so as to allow pushing-in toward this valve member; a first coil spring urging the exhaust button and the valve member away from each other; and a second coil spring urging the exhaust button toward the exterior of the timepiece exterior assembly, characterized in that, when the inner pressure is larger than the spring force of the first coil spring, the valve member is opened, and a part of the gas in the timepiece exterior assembly is accumulated between the valve member and the exhaust button, and when the exhaust button is pushed in, the accumulated gas is discharged to the exterior of the timepiece exterior assembly, and, at this time, the valve member is maintained at the closed position by the spring force of the first coil spring.

In the present invention and the invention described below, the closed position of the valve member implies a position at which the valve member is arranged so as to cut off communication between the space between the valve member and the exhaust member and the interior of the timepiece exterior assembly; conversely, the open position of the valve member implies a position at which the valve member is arranged so as to allow communication between the space between the valve member and the exhaust member and the interior of the timepiece exterior assembly. In the present invention and the invention described below, the spring force of the first coil spring and that of the second coil spring may be the same as or different from each other.

In the portable timepiece of the present invention, when the inner pressure of the timepiece exterior assembly is less than a predetermined pressure, the valve member is maintained at the closed position by the spring force of the first coil spring. When the pressure of the timepiece exterior assembly becomes not less than a predetermined pressure, the valve member is moved to the open position against the first coil spring, and a part of the gas inside the timepiece exterior assembly flows out into the space between the valve member and the exhaust button and is accumulated there. At the same time, the pressure inside the timepiece exterior assembly is reduced, so that it is possible to lower the possibility of an abnormal increase in the inner pressure of the timepiece exterior assembly under the atmospheric pressure. When, due to this reduction in pressure, the pressure in the space between the valve member and the exhaust button becomes equal to the inner pressure of the timepiece exterior assembly, the valve member is moved to the closed position by the first coil spring.

When, in the atmosphere or under water, the exhaust button is pushed in against the first, second coil springs, the gas that has been accumulated in the space between the valve member and the exhaust button is discharged to the exterior of the timepiece exterior assembly. In this case, the valve member, which is arranged at the closed position nearer to the interior of the timepiece exterior assembly with respect to the exhaust button, is pressed by the spring force of the first coil spring that is compressed as the exhaust button is pushed in, and is maintained in the state in which it is arranged at the closed position.

As described above, degassing is effected with the valve arranged at the closed position, so that, if water enters the degassing valve via the periphery of the exhaust button immediately after the degassing, it is possible to make it difficult for the water having entered to get beyond the valve member and reach the interior of the timepiece exterior assembly. When the pushing-in force for the exhaust button is lost, the exhaust button is pushed back to the former position where the pushing-in is possible by the spring force of the first and second coil springs.

Further, to solve the above problem, according to the present invention, there is provided a portable timepiece in which a degassing valve having an exhaust button is attached to a timepiece exterior assembly and in which a gas in the timepiece exterior assembly is allowed to escape to the exterior by pushing in the exhaust button, the degassing valve comprising: a valve casing attached to the timepiece exterior assembly through insertion into a valve mounting hole providing communication between the interior and exterior of the timepiece exterior assembly; a valve member accommodated in the valve casing and moved from a closed position to an open position when the inner pressure of the timepiece exterior assembly becomes a predetermined pressure or more; the exhaust button accommodated in the valve casing so as to allow pushing-in from the outside of the timepiece exterior assembly toward this valve member; a first coil spring urging the exhaust button and the valve member away from each other; and a second coil spring urging the exhaust button toward the exterior of the timepiece exterior assembly, characterized in that the valve casing has a valve hole communicating with the interior of the timepiece exterior assembly, a valve seat surface which is provided around the valve hole and toward and away from which the valve member moves, a spring shoe portion provided around the valve seat surface, a button stop portion forming an opening communicating with the exterior of the timepiece exterior assembly and preventing detachment of the exhaust button in the direction of the exterior of the timepiece exterior assembly, a seal surface continuous from a proximal portion of the button stop portion to the valve seat side, and a clearance groove continuous from the seal surface to the valve seat side, a first seal member being mounted to the valve seat surface or the valve member, there being mounted to the exhaust button a second seal member moving through movement of the exhaust button between a sealing position where it is held in contact with the seal surface and an exhaust position where it is opposed to the clearance groove, the first coil spring being provided between the valve member and the exhaust button, the second coil spring being provided between the spring shoe portion and the exhaust button.

In the portable timepiece of the present invention, when the inner pressure of the timepiece exterior assembly is less than a predetermined force, the valve member is held at the closed position by the spring force of the first coil spring. As a result, the first seal member is held between the valve seat surface and the valve member while exhibiting interference by the spring force of the first coil spring, thereby closing the valve hole. At the same time, when, as stated above, the inner pressure of the timepiece exterior assembly is less than a predetermined force, the exhaust button is caught by the button stop portion of the valve casing by the spring force of the first and second coil springs, and is supported in a state allowing pushing-in, with the second seal member being in contact with the seal surface of the valve casing while exhibiting interference. Here, the expression: the first and second seal members "exhibit interference" implies a state in which the seal members are held in contact with the valve seat surface or the seal surface and elastically deformed so as to be thinner than in the free state or reduced in diameter to be held in intimate contact with the valve seat surface or the seal surface.

When, in this state, the pressure of the timepiece exterior assembly becomes a predetermined force or more, the valve member is moved from the closed position to the open position against the first coil spring, so that a part of the gas inside the timepiece exterior assembly flows out into the space between the valve member and the exhaust button and is accumulated there. At the same time, the pressure inside the timepiece exterior assembly is reduced, so that it is possible to lower the possibility of an abnormal increase in the inner pressure of the timepiece exterior assembly under the atmospheric pressure. And, when, due to this reduction in pressure, the pressure between the valve member and the exhaust button becomes equal to the inner pressure of the timepiece exterior assembly, the valve member is moved from the open position to the closed position by the first coil spring.

When, in the atmosphere or under water, the exhaust button is pushed in against the first and second coil springs, the second seal member, which is moved together with the exhaust button, is detached from the seal surface and opposed to the clearance groove, so that there is formed a gas path by-passing around the second seal member, and, due to this gas path, communication is established between the space between the valve member and the exhaust button and the opening of the valve casing. Thus, the gas that has been accumulated in the space between the valve member and the exhaust button is discharged to the exterior of the timepiece exterior assembly.

In this case, the valve member arranged at the closed position nearer to the interior of the time exterior assembly with respect to the exhaust button is pushed by the spring force of the first coil spring compressed as the exhaust button is pushed in, and maintains the state in which it is arranged at the closed position.

As described above, degassing is effected with the valve member arranged at the closed position, so that if water enters the degassing valve via the periphery of the exhaust button immediately after the degassing, it is possible to make it difficult for the water having entered to get over the valve member and reach the interior of the timepiece exterior assembly. When the pushing-in force for the exhaust button is lost, the exhaust button is pushed back by the spring force of the first and second coil spring to the former position where pushing-in is possible.

A preferred mode of the portable timepiece of the present invention is characterized in that at least one of the valve member and the exhaust button has a gas accumulating recess open to the other.

In this mode of the invention, the amount of gas accumulated in the space between the valve member and the exhaust button increases in accordance with the volume of the gas accumulating recess, so that it is possible to further lower the possibility of an abnormal increase in the inner pressure of the timepiece exterior assembly under the atmospheric pressure.

A preferred mode of the portable timepiece of the present invention is characterized in that the spring force of the second coil spring is weaker than the spring force of the first coil spring.

In this mode of the invention, the force obtained by combining the spring forces of the first and second coil springs does not become not less than double the spring force of the first coil spring, which corresponds to a predetermined pressure inside the timepiece exterior assembly, so that it is possible to push in the exhaust button with a relatively small force though a force corresponding to the predetermined pressure is needed.

A preferred mode of the portable timepiece of the present invention is characterized in that the first seal member has a flat contact surface and is attached to the valve member, and that the valve seat surface is formed by a flat surface, with the diameter of this valve seat surface being larger than the outer diameter of the first seal member.

In this mode of the invention, as compared with the case in which a groove is provided in the valve seat surface and in which the first seal member is attached to this groove, the diameter of the first seal member can be enlarged according to the valve seat surface. Thus, the seal area when the valve member is at the closed position is increased, making it possible to achieve an improvement in the seal performance between the valve member and the valve seat surface.

A preferred mode of the portable timepiece of the present invention is characterized in that the second seal member has a moving-toward/away end surface moving toward and away from the button stop portion.

In this mode of the invention, also the moving-toward/away end surface of the second seal member, which is held in intimate contact with the seal surface of the valve casing in the normal state until the exhaust button is pushed in, is held in intimate contact with the button stop portion of the valve casing, so that the seal surface area increases. Further, in the state in which the pressure between the valve member and the exhaust button has become equal to the pressure inside the timepiece exterior assembly, the exhaust button is pressed by this pressure, causing the moving-toward/away end surface of the second seal member to be more firmly held in intimate contact with the button stop portion. Thus, it is possible to improve the seal property between the exhaust button and the valve casing.

A preferred mode of the portable timepiece of the present invention is characterized in the valve casing is formed by a first valve casing member having the valve hole, the valve seat surface, and the spring shoe portion, and a cylindrical second valve casing member having the button stop portion, the seal surface, and the clearance groove and threadedly engaged with the outer periphery of the first valve casing member.

In this mode of the invention, the exhaust button is inserted into the second valve casing member of the valve casing from an open end on the side opposite to the button stop portion thereof, and then the first and second coil springs are inserted from the open end and are supported by the exhaust button; after this, the valve member is inserted from the open end and supported by the first coil spring; finally, the first valve casing member is passed through the opening and threadedly engaged with the second valve casing member to assemble the valve casing, whereby it is possible to assemble the degassing valve. As described above, this assembly can be executed by sequentially incorporating all the other components into the second valve casing member from one direction, which means the assembly is easy to perform.

A preferred mode of the portable timepiece of the present invention is characterized in that the exhaust button has a spring shoe surface receiving the first coil spring and the second coil spring, and that a plurality of ventilating grooves extending across this spring shoe surface are formed in the exhaust button.

In this mode of the invention, one end of each of the first and second coil spring is held in contact with the spring shoe surface of the exhaust button, so that, as the exhaust button is pressed, each of the first and second coil springs is placed in a closely wound state. In spite of this, communication between the valve member and the exhaust button and between second coil spring on the outer side with respect to the first coil spring and the valve casing is secured by the ventilating grooves, and there is no break in the degassing route. Thus, the gas accumulated between the valve member and the exhaust button can be reliably discharged to the exterior of the timepiece exterior assembly as the exhaust button is pushed in.

According to the present invention, it is possible to provide a portable timepiece in which water is not easily allowed to enter the interior of the timepiece exterior assembly from the outside as degassing operation is performed.

DETAILED DESCRIPTION OF THE PREFERRED EMBODIMENTS

Figure 1:
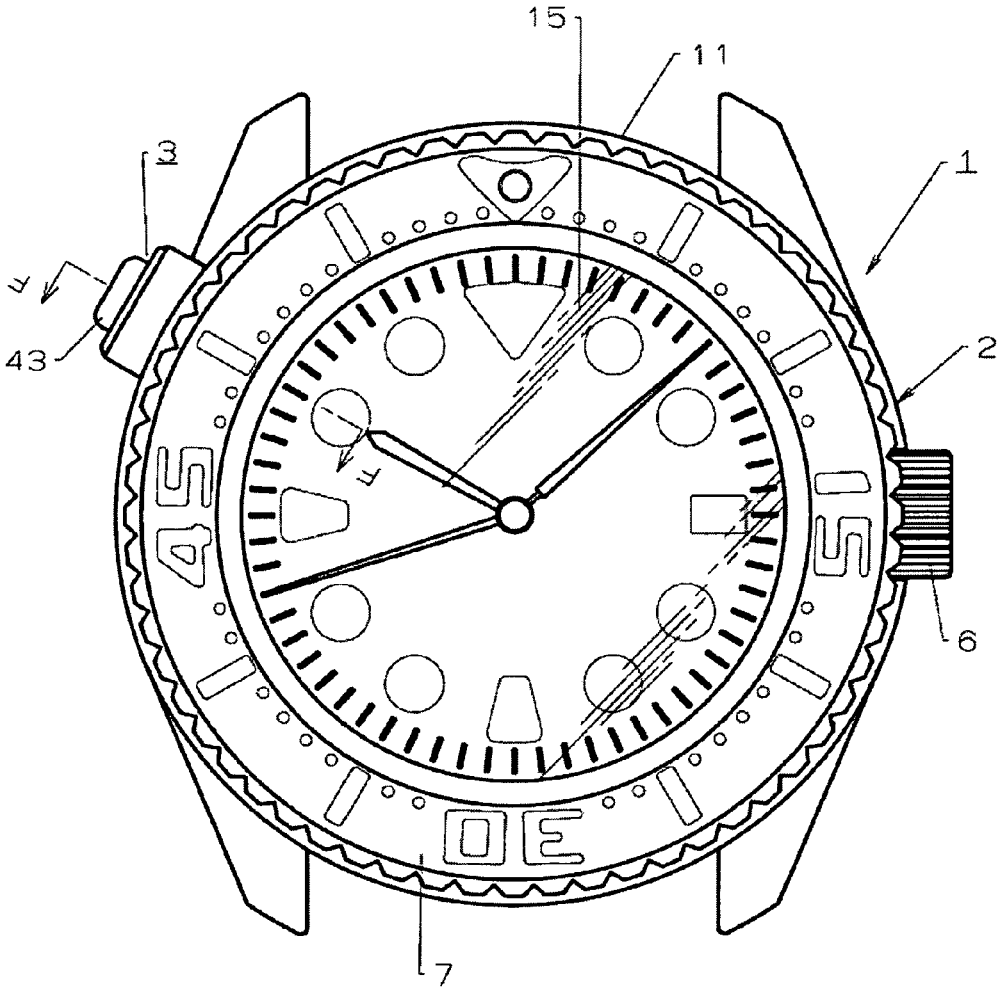
FIG. 1 is a plan view of a wristwatch according to a first embodiment of the present invention.

In the following, the first embodiment of the present invention will be described in detail with reference to FIGS. 1 through 4.

In FIGS. 1 through 4, numeral 1 indicates a portable timepiece, for example, a wristwatch such as a diver's watch also suitable for saturation diving. The wristwatch 1 is equipped with a timepiece exterior assembly 2, and a degassing valve 3 for reducing the inner pressure of the timepiece exterior assembly 2.

Figure 2:
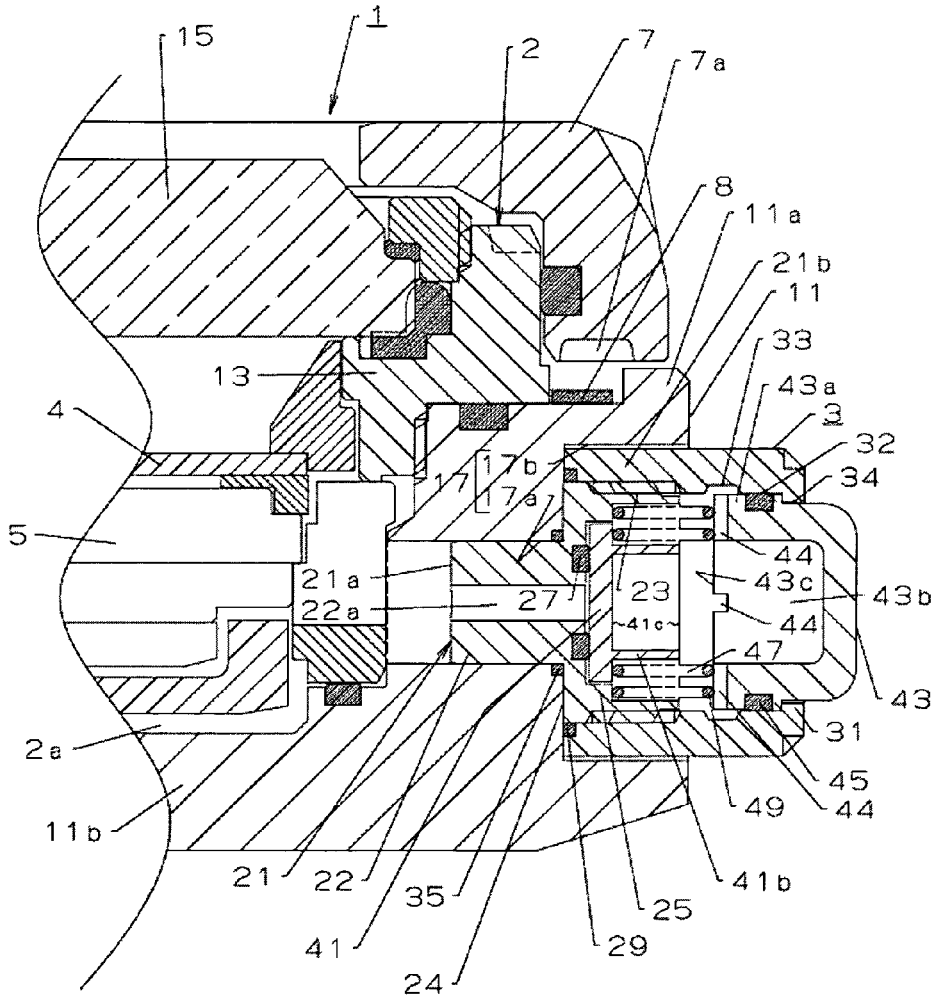
FIG. 2 is a sectional view taken along the line F-F of FIG. 1 showing the wristwatch of the first embodiment prior to degassing via a degassing valve thereof.
Figure 3:
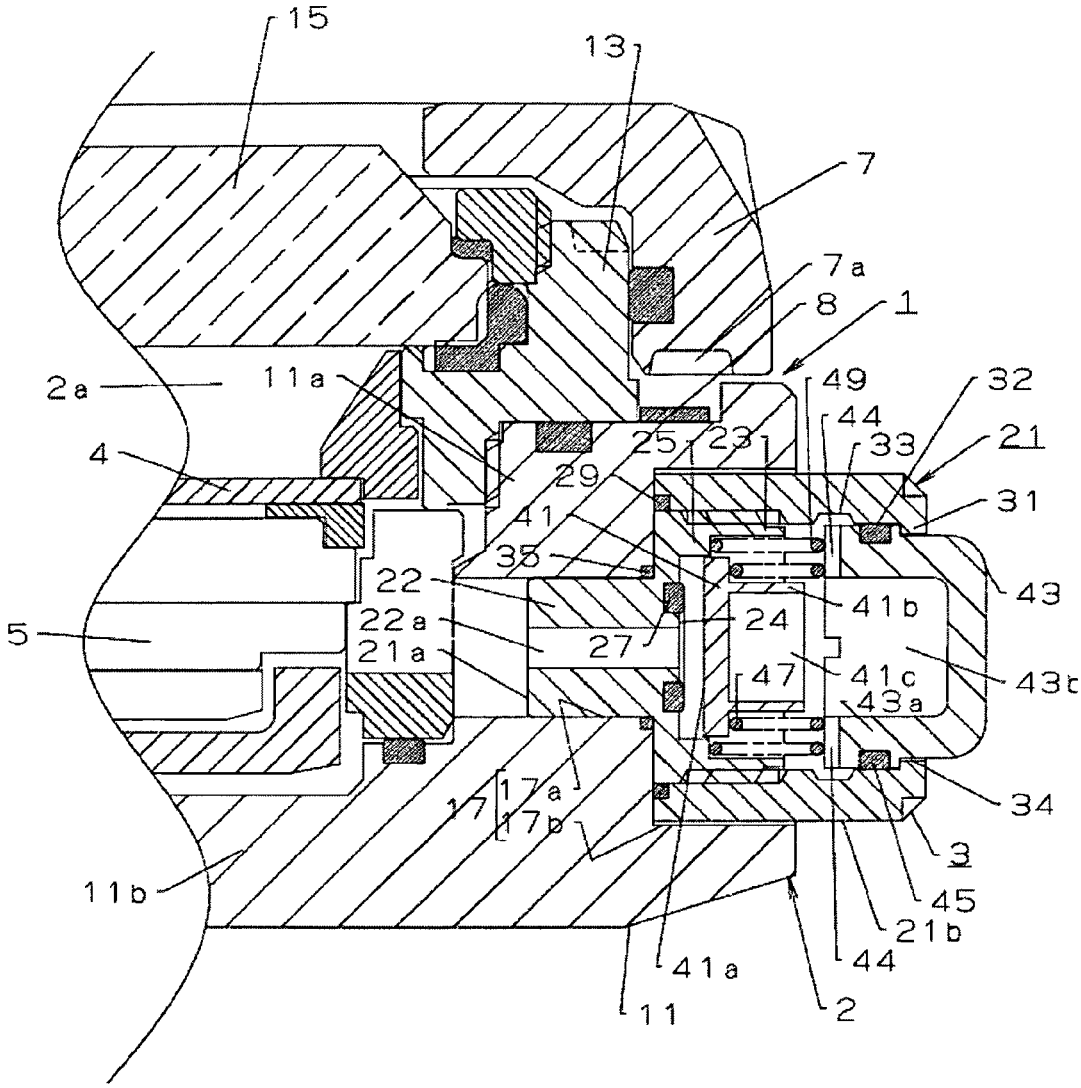
FIG. 3 is a sectional view taken along the line F-F of FIG. 1 showing the wristwatch of the first embodiment with the inner pressure of the timepiece exterior assembly temporarily reduced via the degassing valve thereof.
Figure 4:
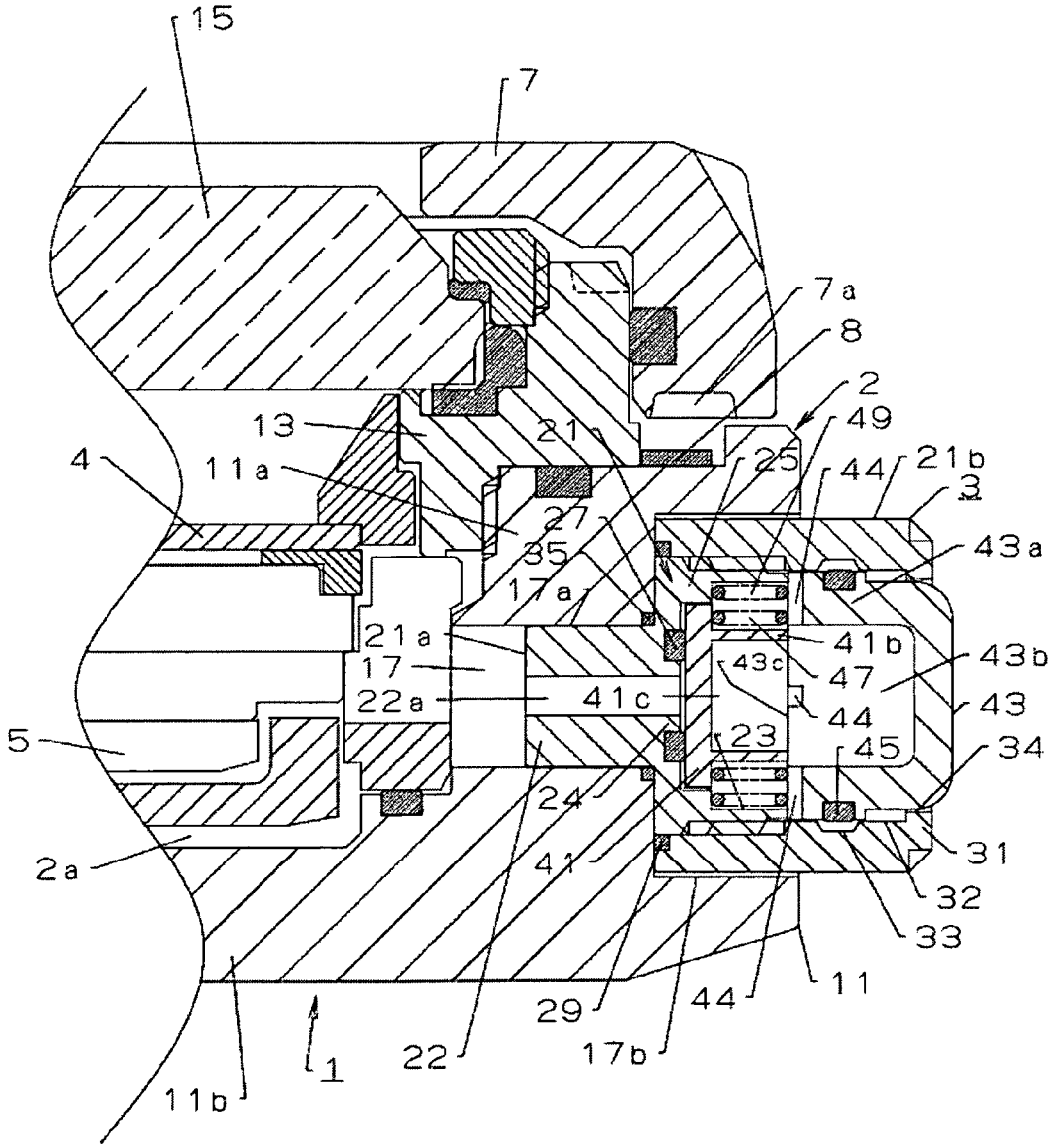
FIG. 4 is a sectional view taken along the line F-F of FIG. 1 showing the wristwatch of the first embodiment in a state of degassing via the degassing valve thereof.

As shown in FIGS. 2 through 4, the timepiece exterior assembly 2 contains a time indication plate 4 and a movement 5, and, as shown in FIG. 1, a crown 6 is mounted to a peripheral portion of the timepiece exterior assembly 2.

The timepiece exterior assembly 2 is equipped with a metal exterior member 11 integrally formed by a case band portion 11*a* and a case back portion 11*b*, a glass support member 13, and a cover glass 15. The glass support member 13 is of a ring-like configuration, and is fixed to the case band portion 11*a* from the front side thereof through threaded engagement.

The cover glass 15 is attached to the inner side of the glass support member 13 in a liquid-tight fashion through the intermediation of waterproof packing, and the back side thereof is opposed to the time indication plate 4.

Instead of the exterior member 11, it is also possible to employ a timepiece exterior assembly 2 of a construction in which threadedly engaged with a case band corresponding to the case band portion 11*a* is a case back separate therefrom and corresponding to the case back portion 11*b*. Further, mounted to the timepiece exterior assembly 2 is a ring-shaped rotary bezel 7 allowing rotation along the outer periphery of the glass support member 13. The rotary bezel 7 is kept at rest at an arbitrary rotating position through engagement of a lock member (not shown) of a lock spring 8 with engagement grooves 7*a* (only of which is shown) provided on the back surface thereof at fixed intervals in the peripheral direction.

As shown in FIGS. 2 through 4, a valve mounting hole 17 is provided, for example, in the case band portion 11*a* of the timepiece exterior assembly 2 so as to extend therethrough. The valve mounting hole 17 is a stepped hole formed by a small diameter hole portion 17*a* consisting of a round hole and a large diameter hole portion 17*b* continuous therewith and consisting of a round hole. The small diameter hole portion 17*a* is open to the interior 2*a* of the timepiece exterior assembly 2, and the large diameter hole portion 17*b* is open to the outer surface of the timepiece exterior assembly 2, for example, the outer surface of the case band portion 11*a*.

The degassing valve 3 is equipped with a valve casing 21, a first seal member 27, a valve member 41, an exhaust button 43, a second seal member 45, a first coil spring 47, and a second coil spring 49.

The valve casing 21 is formed of metal, and is assembled by connecting a first valve casing member 21*a* and a second valve casing member 21*b* as described below.

The first valve casing member 21*a* is formed as a stepped cylinder having an insertion cylindrical portion 22 which is inserted into the small diameter hole portion 17*a* and at one end of which a connection cylindrical portion 23 is integrally provided. The connection cylindrical portion 23 is of a larger diameter than the insertion cylindrical portion 22 but is of a smaller diameter than the large diameter hole portion 17*b*. A male screw portion is formed in the outer periphery of this connection cylindrical portion 23.

The first valve casing member 21*a* has a valve hole 22*a*, a valve seat surface 24, and a spring shoe portion 25.

The valve hole 22*a* is formed by the insertion cylindrical portion 22. The valve seat surface 24 also serves as an end surface of the connection cylindrical portion 23, and is provided around the valve hole 22*a* so as to be continuous with one end of the valve hole 22*a*. This valve seat surface 24 is formed by a flat surface extending in a direction orthogonal to the center axis (not shown) of the valve hole 22*a*, with an annular first seal mounting groove being provided in a portion thereof.

A first seal member 27 is attached to the valve seat surface 24 while fit-engaged with the first seal mounting groove. The first seal member 27 is formed in a ring-like configuration of an elastic material such as rubber or elastomer, and the radial section thereof is rectangular, for example, a radially elongated rectangle. Thus, the surface of the first seal member 27 on the opposite side of the bottom of the first seal mounting groove, that is, the surface in contact with a valve member 41 described below, is a flat surface. The thickness of the first seal member 27 is larger than the depth of the first seal mounting groove.

The spring shoe portion 25 is provided on the inner side of the connection cylindrical portion 23 and substantially at the center in the axial direction of the connection cylindrical portion 23. The spring shoe portion 25 is of an annular configuration, and is provided around the valve seat surface 24. A relatively shallow circular valve member receiving recess is formed by the valve seat surface 24 and the spring shoe portion 25. That is, the valve seat surface 24 constitutes the bottom surface of the valve member receiving recess, and the spring shoe portion 25 constitutes a side surface of the valve member receiving recess.

The second valve casing member 21*b* is substantially of a cylindrical configuration, and the outer diameter thereof is slightly smaller than the hole diameter of the large diameter hole portion 17*b*. A female screw portion is formed in the inner periphery of one end portion of the second valve casing member 21*b*. Through threaded engagement of this female screw portion with the male screw portion, the second valve casing member 21*b* is connected to the outer periphery of the first valve casing member 21*a*. Further, the seal member indicated by numeral 29 in FIGS. 2 through 4 is formed in a ring-like shape of an elastic material such as rubber or elastomer, and is held between the first and second valve casing members in order to secure the watertightness between the first valve casing member 21*a* and the second valve casing member 21*b*.

The length of the second valve casing member 21*b* is larger than the depth of the large diameter hole portion 17*b*. The second valve casing member 21*b* has a button stop portion 31, a seal surface 32, and a clearance groove 33.

The button stop portion 31 is provided on the inner side of the second valve casing member 21*b* so as to integrally protrude therefrom. The button stop portion 31 is continuous one round in the peripheral direction of the second valve casing member 21*b*, and forms an opening 34, for example, at the other end of the second valve casing member 21*b*. Due to the opening 34, communication is established between the interior and exterior of the valve casing 21.

The seal surface 32 is formed by a part of the inner peripheral surface of the second valve casing member 21*b*, and is continuous from the proximal end of the button stop portion 31 to the valve seat surface 24 side of the first valve casing member 21*a*. The clearance groove 33 is open to the inner peripheral surface of the second valve casing member 21*b*, and is provided between the button stop portion 31 and the female screw portion. The clearance groove 33 is formed so as to be continuous one round in the peripheral direction of the inner peripheral surface of the second valve casing member 21*b*. The opening width of the clearance groove 33 is larger than the width of a second seal member 45 described below.

The valve casing 21 constructed as described above is mounted to the case band portion 11*a* of the timepiece exterior assembly 2 by forcing the insertion cylindrical portion 22 of the first valve casing member 21*a* thereof into the small diameter hole portion 17*a* from the outer side of the timepiece exterior assembly 2, and accommodating a part of the second valve casing member 21*b* in the large diameter hole portion 17*b*. The fixation of the valve casing 21 to the case band portion 11*a* is effected by brazing the first valve casing member 21*a* to the case band portion 11*a* by a brazing material 35. The valve hole 22*a* of the valve casing 21 mounted to the timepiece exterior assembly 2 communicates with the interior 2*a* of the timepiece exterior assembly 2, and the button stop portion 31 side portion of the valve casing 21 protrudes to the exterior of the timepiece exterior assembly 2.

The valve member 41 is accommodated in the valve casing 21 so as to be movable in the axial direction of the valve casing 21. The valve member 41 is formed, for example, of metal, of a smaller diameter than the spring shoe portion 25, and is formed in a size suitable for fit-engagement with the valve receiving recess of the valve casing 21 allowing extraction and insertion. The valve member 41 has a seating surface 41*a* (See FIG. 3) holding the first seal member 27 between itself and the valve seat surface 24, and has, on the back side with respect to the seating surface 41*a*, a cylindrical portion 41*b* and a gas accumulating recess 41*c* surrounded by this. The outer diameter of the cylindrical portion 41*b* is smaller than the diameter of the valve member 41. The gas accumulating recess 41*c* is not indispensable.

The exhaust button 43 is opposed to the valve member 41 from the opening 34 side and is accommodated in the valve casing 21 so as to be movable in the axial direction of the valve casing 21. The exhaust button 43 is formed, for example, of metal, and has a second seal member mounting groove continuous one round in the peripheral direction in the outer peripheral portion of the valve member 41 side end portion 43*a*.

The second seal member 45 is attached to the second seal mounting groove. The second seal member 45 is formed in a ring-like shape of an elastic material such as rubber or elastomer, and the radial section thereof is of a rectangular configuration, e.g., a rectangle elongated in the width direction. Thus, the contact surface of the second seal member 45 with respect to the seal surface 32 is a flat surface. Through reciprocating movement of the exhaust button 43, the second seal member 45 can move between the sealing position where it is held in intimate contact with the seal surface 32 and the exhaust position where it is opposed to the clearance groove 33.

The diameter of the end portion 43*a* is smaller than that of the hole formed by the seal surface 32, and larger than the diameter of the opening 34. The end portion 43*a* functions as a stopper which can move toward and away from the button stop portion 31 from the valve member 41 side as the exhaust button 43 moves; by being caught through contact with the button stop portion 31, the exhaust button 43 is prevented from being detached from the valve casing 21. The outer diameter of the peripheral portion of the exhaust button 43 other than the end portion 43*a* is smaller than the diameter of the opening 34, whereby the exhaust button 43 extends through the opening 34 and protrudes to the exterior of the valve casing 21, thus enabling pushing-in.

The exhaust button 43 has a gas accumulating recess 43*b*. The gas accumulating recess 43*b* is opposed to the gas accumulating recess 41*c* of the valve member 41. The gas accumulating recess 41*c* is not indispensable. When providing a gas accumulating recess, such a recess is provided in at least one of the valve member 41 and the exhaust button 43 so as to be open to the other.

The exhaust button 43 has a spring shoe surface 43*c* (See FIG. 2). The spring shoe surface 43*c* is formed by an end surface of an end portion 43*a* forming an edge portion of the opening of the gas accumulating recess 43*b*. A plurality of ventilating grooves 44 are formed in the spring shoe surface 43*c*. The ventilating grooves 44 are provided at intervals in the peripheral direction of the end portion 43*a*, and extend across the spring shoe surface 43*c*.

One end of the first coil spring 47 is supported by the peripheral portion of the valve member 41, and the other end thereof is supported by the spring shoe surface 43*c*, with the first coil spring being provided in a compressed state between the valve member 41 and the exhaust button 43. Thus, the valve member 41 and the exhaust button 43 are urged away from each other by the spring force of the first coil spring 47. When the interior 2*a* of the timepiece exterior assembly 2 attains an inner pressure level not less than a predetermined inner pressure, to reduce the inner pressure, the spring force of the first coil spring 47 regulates the pressure with which the valve member 41 is opened.

The second coil spring 49 is of a larger diameter than the first coil spring 47. One end of the second coil spring 49 is supported by the spring shoe portion 25, and the other end thereof is supported by a spring shoe surface 43*c*, with the second coil spring being provided in a compressed state between the first valve casing member 21*a* of the valve casing 21 and the exhaust button 43. Thus, the exhaust button 43 is urged so as to protrude from the opening 34, in other words, toward the exterior of the timepiece exterior assembly 2.

The spring force of the first coil spring 47 is weaker than the spring force of the second coil spring 49. At the same time, the spring force of the first coil spring 47 is set to be not less than a predetermined pressure of the interior 2*a* of the timepiece exterior assembly 2 and less than double the predetermined pressure. Thus, while a force corresponding to the predetermined pressure is required, it is possible to push in the exhaust button 43 with a relatively small force.

As described above, in the degassing valve 3 constructed as described above, the valve casing 21 thereof is formed by the first casing member 21*a* having the valve seat surface 24 and the spring shoe portion 25, and the cylindrical second valve casing member 22*b* having the button stop portion 31, the seal surface 32, and the clearance groove 33 and threadedly engaged with the outer periphery of the first valve casing member 21*a*, so that the degassing valve 3 can be easily assembled by the following procedures.

First, the exhaust button 43 is inserted into the second valve casing member 21*b* of the valve casing 21 from the side opposite to the button stop portion 31 thereof, that is, from the open end on the side where the female screw portion is formed, and the button stop portion 31 is caused to support the exhaust button 43. Next, the first coil spring 47 and the second coil spring 49 are inserted from the open end, and these are supported by the spring shoe surface 43*c* of the exhaust button 43. After this, the valve member 41 is inserted from the open end, and the cylindrical portion 41*b* thereof is inserted into the inner side of the first coil spring 47, whereby the valve member 41 is supported by the first coil spring 47. Finally, the first valve casing member 21*a* is passed through the open end, and is threadedly engaged with the valve casing member 21*b* while compressing the first coil spring 47 and the second coil spring 49, thus assembling the valve casing 21. In this way, the degassing valve 3 can be assembled by successively incorporating into the second valve casing member 21*b* all the components other than that from one direction, so that the assembly operation can be easily conducted.

In the normal state of the wristwatch 1 shown in FIG. 2, the exhaust button is caused to protrude to the exterior of the timepiece exterior assembly 2 to a maximum degree by the spring force of the first coil spring 47 and the second coil spring 49, and pushing-in is possible. In this state, the end portion 43*a* of the exhaust button 43 is caught by the button stop portion 31 of the valve casing 21, and the exhaust button 43 is prevented from being detached from the valve casing 21. At the same time, the second seal member 45 is deviated to the button stop portion 31 side with respect to the clearance groove 33 and is elastically deformed, that is, the valve member 41 is slidably held in intimate contact with the seal surface 32 while exhibiting interference. Here, when the second seal member 45 is arranged so as to exhibit interference, the second seal member 45 is regarded as arranged at a sealing position. At this sealing position, airtightness and watertightness in the vicinity of the opening 34 are maintained.

Further, in the normal state of the wristwatch 1 shown in FIG. 2, the valve member 41 is being pushed toward the valve seat surface 24 by the spring force of the first coil spring 47, and the seating surface 41*a* of the valve member 41 is held in intimate contact with the first seal member 27. That is, the valve member 41 holds the first seal member 27 in an elastically deformed state between the seating surface 41*a* thereof and the valve seat surface 24, closing the valve hole 22*a*. Here, when the valve 41 is thus arranged, the valve member 41 is regarded as arranged at a closed position. Airtightness and watertightness in the vicinity of the valve hole 22*a* are maintained.

In saturation diving, a seal member penetrating gas such as helium gas used in an under-water residential area is transmitted through the seal member around the cover glass 15 and the seal member around the degassing valve 3, so that the gas pressure inside the timepiece exterior assembly 2 is enhanced.

When the force pressing the seating surface 41*a* of the valve member becomes stronger than the spring force of the first coil spring 47 due to the gas pressure inside the timepiece exterior assembly 2, the valve member 41 is then moved toward the exhaust button 43 while further compressing the first coil spring 47. As a result, the valve member 41 is detached from the valve seat 24 with the first seal member 27 attached thereto, and the valve hole 22*a* is opened. Here, when the valve member 41 is thus arranged, the valve member 41 is regarded as arranged at an open position, which state is shown in FIG. 3.

Then, a part of the gas in the interior 2*a* of the timepiece exterior assembly 2 passed through the valve hole 22*a*, and flows out into the inner space of the valve casing 21 inclusive of the space between the valve member 41 and the exhaust button 43, so that the inner pressure of the interior 2*a* is temporarily reduced. In this case, the valve member 41 has a gas accumulating recess 41*c*, and the exhaust button 43 also has a gas accumulating recess 43*b*, so that it is possible to increase the amount of gas accumulated between the valve member 41 and the exhaust button 43 according to their volume. Thus, after saturation diving, it is possible to further lower the possibility of an abnormal increase in the inner pressure of the timepiece exterior assembly 2 under the atmospheric pressure.

When, through the above reduction in pressure, the pressure between the valve member 41 and the exhaust button 43 becomes equal to the pressure in the interior 2*a* of the timepiece exterior assembly 2, the valve member 41 is moved to the closed position shown in FIG. 2 by the spring force of the first coil spring 47.

This automatic opening/closing operation of the valve member 41 is performed regardless of the use of the wristwatch 1 under water or in the atmosphere, so that, in the state in which the user has risen to the surface of the water from the residential area under water, the difference between the atmospheric pressure and the inner pressure of the timepiece exterior assembly 2 does not become excessively large, thus making it possible to reduce the fear of damage of the cover glass 15.

After the user has risen to the surface of the water from the residential area under water, the user performs pushing-in operation on the exhaust button 43 while compressing both the first coil spring 47 and the second coil spring 49 of the degassing valve 3, whereby the gas that has been accumulated between the valve 41 and the exhaust button 43, etc. is forcibly discharged to the exterior of the timepiece exterior assembly 2.

That is, as the exhaust button 43 is pushed in, the second seal member 45 slides on the seal surface 32 of the valve casing 21 to be detached from the sealing position, and, at the same time, reaches the exhaust position where it is opposed to the clearance groove 33 of the valve casing 21 while exhibiting no interference. As a result, a ventilating path is formed between the second seal member 45 and the clearance groove 33, and, via this ventilating path, there is established communication between the space between the valve member 41 and the exhaust button 43 and the opening 34 of the valve casing 21, so that the gas that has been accumulated in the space in the valve casing 21 inclusive of the space between the valve member 41 and the exhaust button 43 is discharged to the exterior of the timepiece exterior assembly 2 via the opening 34. FIG. 4 shows this degassing state.

In this case, one end of each of the first coil spring 47 and the second coil spring 49 is in contact with the spring shoe surface 43*c* of the exhaust button 43, so that, as the exhaust button 43 is pressed, each of the first coil spring 47 and the second coil spring 49 is placed in a closely wound state. However, due to the plurality of ventilating grooves 44 provided in the spring shoe surface 43*c*, communication is secured between the valve member 41 and the exhaust button 43 and between the second coil spring 49 at the outer position with respect to the first coil spring 47 and the second valve casing member 21*b* of the valve casing 21. Thus, there is no break in the degassing route, and it is possible to reliably discharge the gas accumulated between the valve member 41 and the exhaust button 43 to the exterior of the timepiece exterior assembly 2.

Further, in the above degassing, the valve member 41 arranged at the closed position nearer to the interior 2*a* of the timepiece exterior assembly 2 with respect to the exhaust button 43 is pressed against the valve seat surface 24 by the spring force of the first coil spring 47 further compressed as the exhaust button 43 is pushed in. As a result, the valve member 41 reliably keeps the state in which it is arranged at the closed position.

That is, as described above, degassing is effected with the valve member 41 reliably arranged at the closed position. Thus, if, for example, the exhaust button 43 is erroneously pushed in under water, and water is allowed to enter the degassing valve 3 via the periphery of the exhaust button 43 immediately after the resultant degassing, it is difficult for the water having entered to get over the valve member 41 and reach the interior 2*a* of the timepiece exterior assembly 2, so that it is possible to achieve a high level of safety in terms of watertightness.

When the pushing-in force for the exhaust button 43 is lost, the exhaust button 43 is pushed back to the former position where pushing-in is possible by the spring force of the first coil spring 47 and the second coil spring 49, whereby the state of FIG. 2 is restored.

Figure 5:
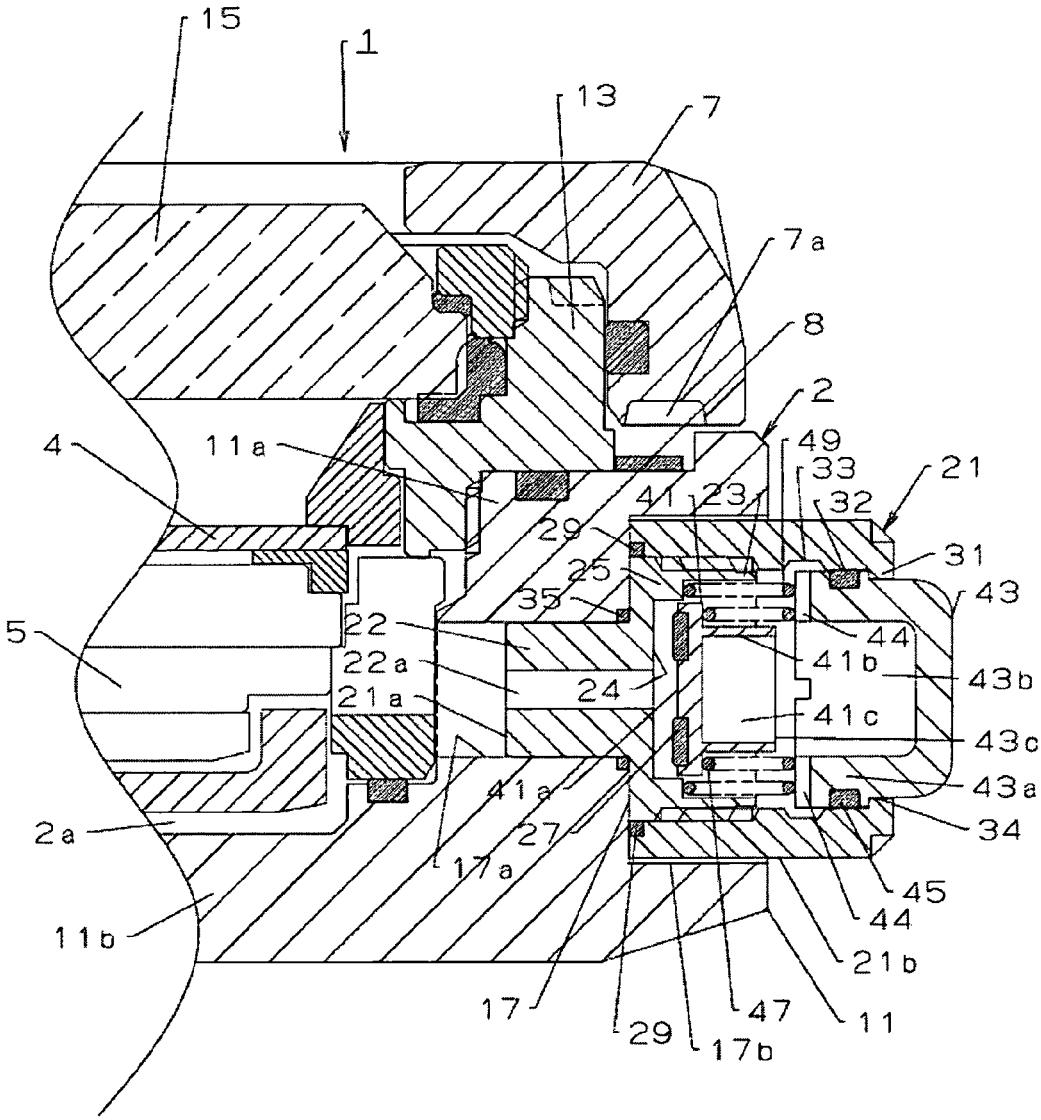
FIG. 5 is a sectional view corresponding to FIG. 3, showing a wristwatch according to a second embodiment of the present invention with the inner pressure of the timepiece exterior assembly temporarily reduced via the degassing valve thereof.

The second embodiment of the present invention will be described with reference to FIG. 5. Except for the matter described below, the second embodiment is the same as the first embodiment, so the same components as those of the first embodiment are indicated by the same reference numerals, and a description thereof will be omitted.

In the second embodiment, the first seal member 27 is attached to the valve member 41 instead of being attached to the valve seat surface 24 of the timepiece exterior assembly 2. Thus, no seal mounting groove is formed in the valve seat surface 24, with the valve seat surface 24 being formed as a flat surface. At the same time, an annular seal mounting groove is formed in the seating surface 41*a* of the valve member 41, and the first seal member 27 is fit-engaged with this groove, whereby the first seal member 27 is attached to the valve member 41. The surface of the first seal member 27 moving toward and away from the valve seat surface 24 consists of a flat contact surface. The diameter of the valve seat surface 24 is larger than the outer diameter of the first seal member 27.

By thus attaching the first seal member 27 to the valve member 41, as compared with the case in which the first seal member 27 is attached to the groove of the valve seat surface 24 as in the first embodiment, it is possible to enlarge the diameter of the first seal member 27 according to the valve seat surface 24, with the result that it is possible to increase the seal area when the valve member 41 is at the closed position. Thus, it is possible to improve the seal performance between the valve member 41 and the valve seat surface 24.

Except for the matter described above, the wristwatch 1 of the second embodiment is of the same construction as the first embodiment. Thus, in the second embodiment also, it is possible to solve the problem of the present invention for the reason already stated above with regard to the first embodiment.

The third embodiment of the present invention will be described with reference to FIGS. 6 through 8. Except for the matter described below, the third embodiment is the same as the first embodiment, so the same components as those of the first embodiment are indicated by the same reference numerals, and a description thereof will be omitted.

In the third embodiment, the second seal member 45 attached to the end portion 43*a* of the exhaust button 43 has a moving-toward/away end surface 45*a* exposed with respect to the end surface 43*a*. The moving-toward/away end surface 45*a* is continuous with the outer peripheral surface of the second seal member 45 in contact with the seal surface 32 so as to be perpendicular thereto, and is formed as an end surface on the side opposite to the spring shoe surface 43*c*. The moving-toward/away end surface 45*a* is of an annular configuration, and can move toward and away from the button stop portion 31 of the valve casing 21 as the exhaust button 43 moves. That is, as shown in FIG. 8, in the state which the exhaust button 43 has been pushed in, the moving-toward/away end surface 45*a* is separated from the inner side surface 31*a* of the button stop portion 31, and pushed back by the second coil spring 49; in this state, as shown in FIGS. 6 and 7, it is brought into contact with the inner side surface 31*a* of the button stop portion 31.

Figure 6:
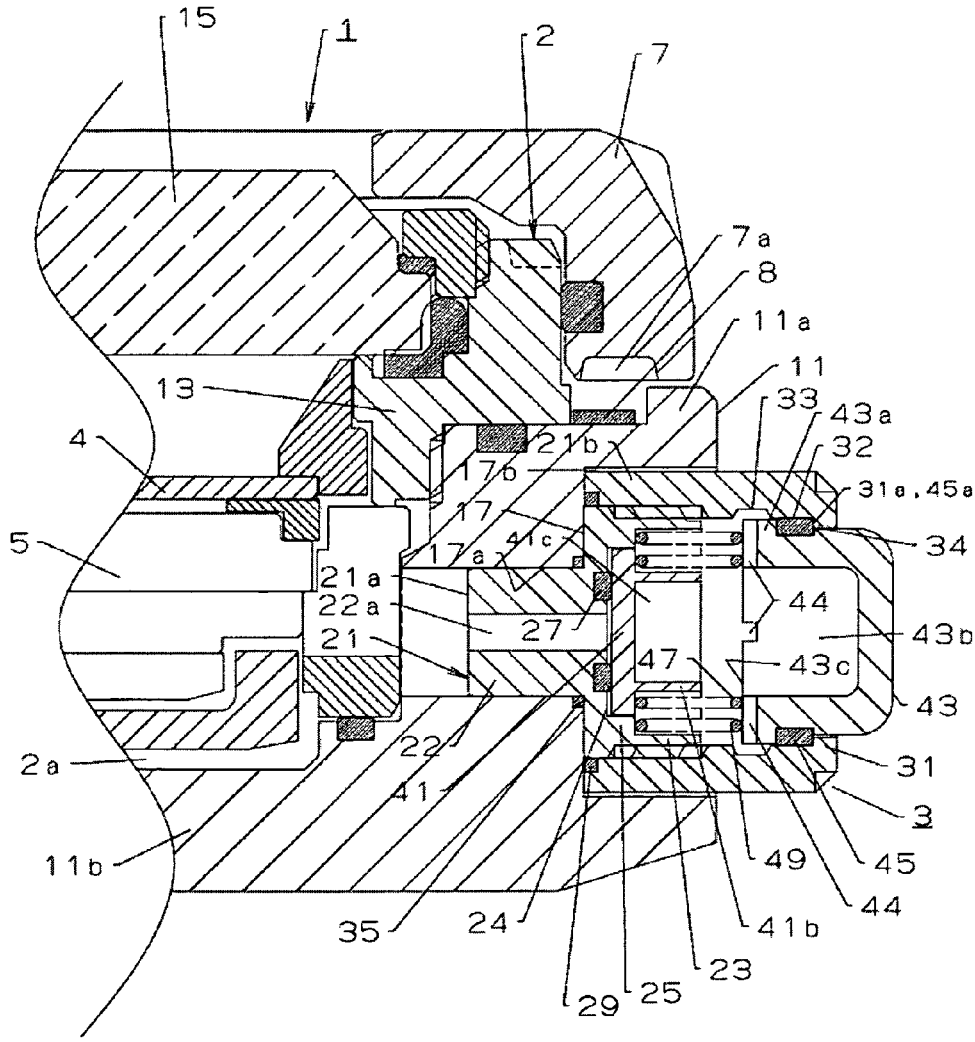
FIG. 6 is a sectional view corresponding to FIG. 2, showing a wristwatch according to a third embodiment of the present invention prior to degassing via a degassing valve thereof.
Figure 7:
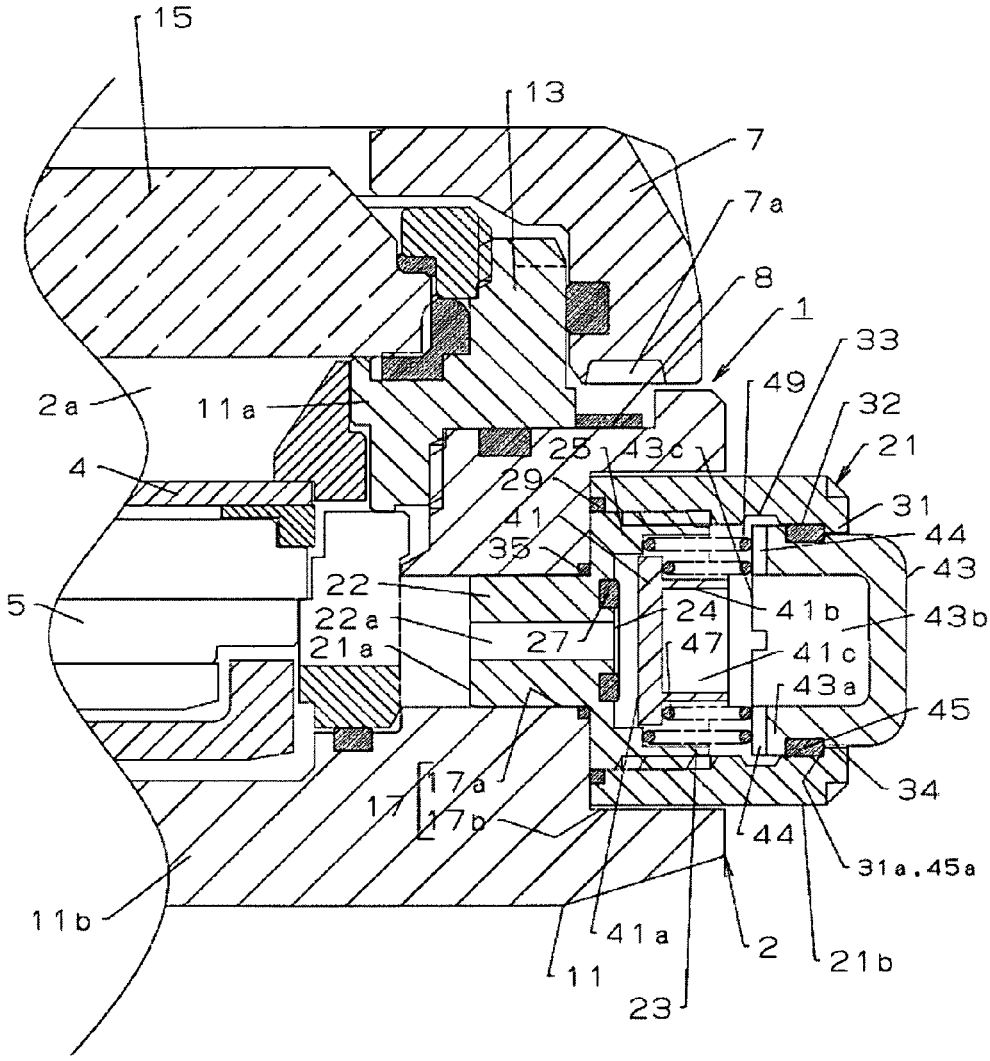
FIG. 7 is a sectional view corresponding to FIG. 3, showing the wristwatch of the third embodiment of the present invention with the inner pressure of the timepiece exterior assembly temporarily reduced via the degassing valve thereof.
Figure 8:
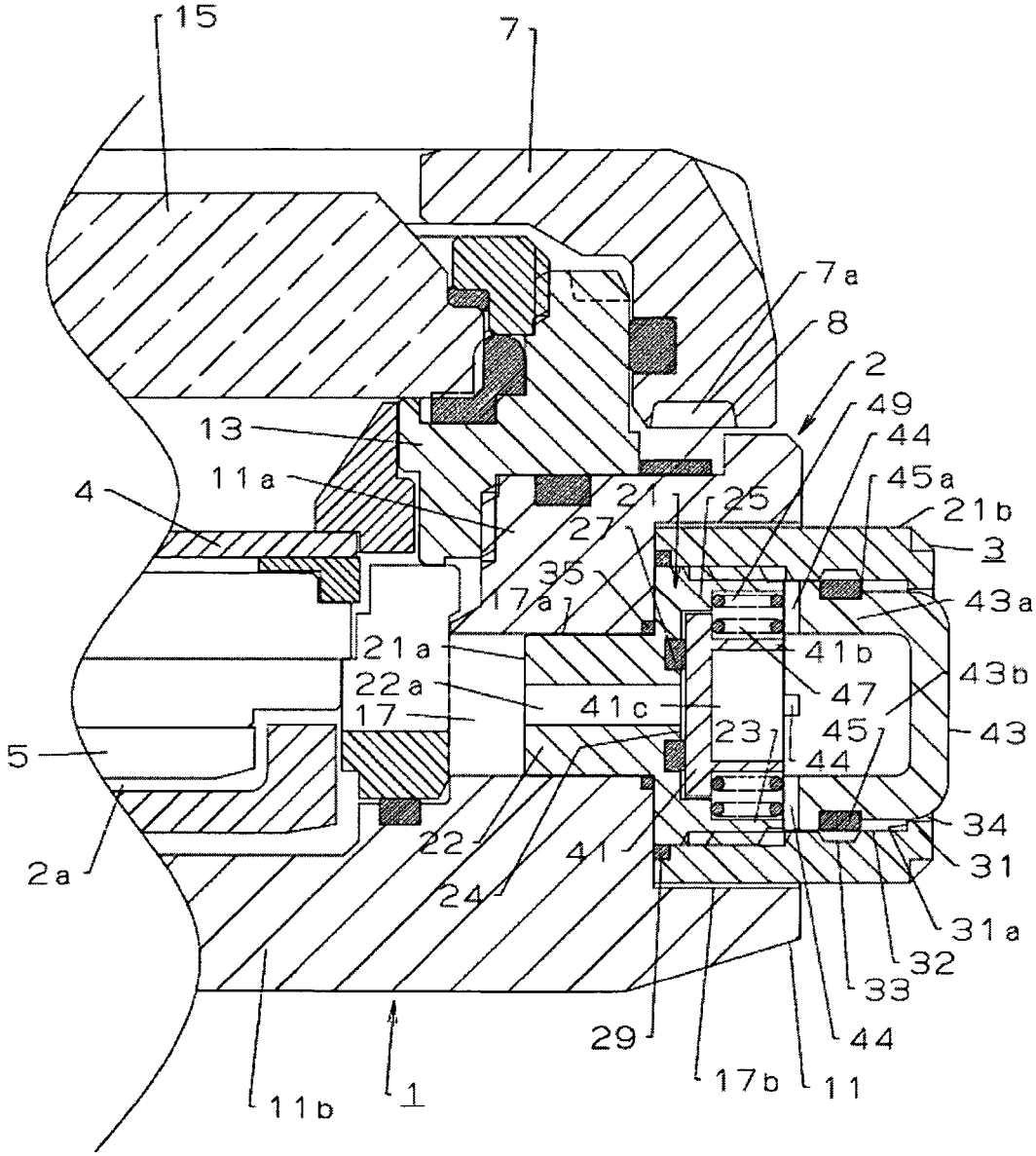
FIG. 8 is a sectional view corresponding to FIG. 4, showing the wristwatch of the third embodiment in a state of degassing via the degassing valve thereof.

In this way, there is provided a second seal member 45 moving toward and away from the button stop portion 31, whereby, as shown in FIGS. 6 and 7, it is possible to improve the seal performance between the valve casing 21 and the exhaust button 43 in the state in which the exhaust button 43 has not been pushed in. That is, in addition to the intimate contact of the outer peripheral surface of the second seal member 45 with the seal surface 32, the moving-toward/away end surface 45*a* of the second seal member 45 can be brought into intimate contact with the inner side surface 31*a* of the button stop portion 31, so that it is possible to effect sealing while securing a large seal area.

Further, in the state in which, as shown in FIG. 7, the valve member 41 is opened and the pressure between the valve member and the exhaust button 43 has become equal to the pressure of the interior 2*a* of the timepiece exterior assembly 2, the exhaust button 43 is pushed to the exterior of the timepiece exterior assembly 2, so that the moving-toward/away end surface 45*a* of the second seal member 45 is held more firmly in intimate contact with the inner side surface 31*a* of the button stop portion 31. Thus, it is possible to further improve the seal property between the exhaust button 43 and the valve casing 21 in the state of FIG. 7.

Except for the matter described above, the wristwatch 1 of the third embodiment is of the same construction as the first embodiment. Thus, in the third embodiment also, it is possible to solve the problem of the present invention for the reason already stated above with regard to the first embodiment.

What is claimed is:

1. A portable timepiece comprising:

a timepiece exterior assembly; and a degassing valve operable to allow a gas in an interior of the timepiece exterior assembly to escape to an exterior of the timepiece exterior assembly, the degassing valve comprising: a valve casing providing communication between the interior and exterior of the timepiece exterior assembly; a valve member accommodated in the valve casing and configured to be moved from a closed position to an open position when an inner pressure of the timepiece exterior assembly becomes a predetermined pressure or more; an exhaust button attached to the timepiece exterior assembly and configured to be pushed into the valve casing toward the valve member; a first coil spring for urging the exhaust button and the valve member away from each other; and a second coil spring for urging the exhaust button toward the exterior of the timepiece exterior assembly;

wherein when the inner pressure of the timepiece exterior assembly is greater than a spring force of the first coil spring, the valve member is moved to the open position, and a portion of the gas in the timepiece exterior assembly accumulates between the valve member and the exhaust button; and wherein when the exhaust button is pushed into the valve casing, the accumulated gas is discharged to the exterior of the timepiece exterior assembly, and, at this time, the valve member is maintained at the closed position by the spring force of the first coil spring.

2. A portable timepiece according to claim 1; wherein at least one of the valve member and the exhaust button has a gas accumulating recess opening to the other of the valve member and the exhaust button.

3. A portable timepiece according to claim 1; wherein a spring force of the second coil spring is weaker than a spring force of the first coil spring.

4. A portable timepiece according to claim 1; wherein the exhaust button has a spring shoe surface receiving the first coil spring and the second coil spring; and further comprising a plurality of ventilating grooves formed in the exhaust button and extending across the spring shoe surface.

5. A portable timepiece comprising:

a timepiece exterior assembly: and a degassing valve operable to allow a gas in an interior of the timepiece exterior assembly to escape to an exterior of the timepiece exterior assembly, the degassing valve comprising: a valve casing attached to the timepiece exterior assembly through insertion into a valve mounting hole providing communication between the interior and exterior of the timepiece exterior assembly; a valve member accommodated in the valve casing and configured to be moved from a closed position to an open position when an inner pressure of the timepiece exterior assembly becomes a predetermined pressure or more; an exhaust button attached to the timepiece exterior assembly and configured to be moved into the valve casing toward the valve member from the outside of the timepiece exterior assembly; a first coil spring for urging the exhaust button and the valve member away from each other; and a second coil spring for urging the exhaust button toward the exterior of the timepiece exterior assembly;

wherein the valve casing of the degassing valve has a valve hole communicating with the interior of the timepiece exterior assembly, a valve seat surface provided around the valve hole, a spring shoe portion provided around the valve seat surface, a button stop portion forming an opening communicating with the exterior of the timepiece exterior assembly and configured to prevent detachment of the exhaust button in the direction of the exterior of the timepiece exterior assembly, a seal surface continuous from a proximal portion of the button stop portion to the valve seat side, and a clearance groove continuous from the seal surface to the valve seat side;

wherein a first seal member is mounted to the valve seat surface of the valve casing or to the valve member of the degassing valve, and a second seal member is mounted to the exhaust button for undergoing movement with the exhaust button between a sealing position in which the second seal member is held in contact with the seal surface and an exhaust position where the second seal member is opposed to the clearance groove; and wherein the first coil spring is provided between the valve member and the exhaust button, and the second coil spring is provided between the spring shoe portion and the exhaust button.

6. A portable timepiece according to claim 5; wherein the first seal member has a flat contact surface and is attached to the valve member, and the valve seat surface is formed by a flat surface and has a diameter larger than an outer diameter of the first seal member.

7. A portable timepiece according to claim 5; wherein the second seal member has an end surface configured to move toward and away from the button stop portion in accordance with movement of the exhaust button.

8. A portable timepiece according to claim 2; wherein the valve casing comprises: a first valve casing member having the valve hole, the valve seat surface, and the spring shoe portion; and a cylindrical second valve casing member threadedly engaged with the first valve casing member and having the button stop portion, the seal surface, and the clearance groove.

9. A portable timepiece according to claim 5; wherein at least one of the valve member and the exhaust button has a gas accumulating recess opening to the other of the valve member and the exhaust button.

* * * * *